US009856100B2

(12) United States Patent
Tanaka et al.

(10) Patent No.: US 9,856,100 B2
(45) Date of Patent: Jan. 2, 2018

(54) SHEET GUIDING MECHANISM, IMAGE FORMING APPARATUS

(71) Applicant: KYOCERA Document Solutions Inc., Osaka-shi, Osaka (JP)

(72) Inventors: Yuichiro Tanaka, Osaka (JP); Yuya Shimohora, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/264,378

(22) Filed: Sep. 13, 2016

(65) Prior Publication Data

US 2017/0090383 A1 Mar. 30, 2017

(30) Foreign Application Priority Data

Sep. 30, 2015 (JP) ..... 2015-194317

(51) Int. Cl.

| | |
|---|---|
| ***B65H 5/00*** | (2006.01) |
| ***B65H 5/36*** | (2006.01) |
| ***G03G 15/00*** | (2006.01) |
| ***B65H 5/06*** | (2006.01) |
| ***B65H 5/38*** | (2006.01) |

(52) U.S. Cl.

CPC ..... *B65H 5/36* (2013.01); *B65H 5/062* (2013.01); *B65H 5/38* (2013.01); *G03G 15/6529* (2013.01); *B65H 2404/1371* (2013.01); *B65H 2404/54* (2013.01); *G03G 15/6558* (2013.01); *G03G 2215/00675* (2013.01)

(58) Field of Classification Search

CPC ..... B65H 5/06; B65H 5/062; B65H 5/066; B65H 5/36; B65H 5/38; B65H 2404/1122; B65H 2404/134; B65H 2404/1341; B65H 2404/1345; B65H 2404/137; B65H 2404/1371; B65H 2404/1372; B65H 2404/54; B65H 2404/56; B65H 2511/17

USPC ..... 271/264

See application file for complete search history.

(56) References Cited

U.S. PATENT DOCUMENTS 4,889,270 A * 12/1989 Gomoll ..... B65H 5/062 226/181

7,669,849 B2 * 3/2010 Liu ..... B65H 5/06 271/272

(Continued)

FOREIGN PATENT DOCUMENTS

JP 07076435 A 3/1995

*Primary Examiner* — Prasad V Gokhale

(74) *Attorney, Agent, or Firm* — Alleman Hall Creasman & Tuttle LLP

(57) ABSTRACT

A sheet guiding mechanism includes a pair of first rotators and a pair of second rotators provided in a conveying path for a sheet material, a first sheet guide portion, a second sheet guide portion, a shaft member, and a plurality of guide rollers. The first sheet guide portion and the second sheet guide portion form guide surfaces for the sheet material on both sides of the conveying path. Both end portions of the shaft member extending along a width direction are supported by the second sheet guide portion. The guide rollers are in contact with the sheet material conveyed in the conveying path, and rotate to follow the sheet material. The shaft member is bent by a pressure applied from the sheet material to the guide rollers when a tension is applied to the sheet material between the pair of first rotators and the pair of second rotators.

8 Claims, 3 Drawing Sheets

(56) References Cited

U.S. PATENT DOCUMENTS

| | | | | |
|---|---|---|---|---|
| 8,991,817 | B1 * | 3/2015 | Terao | B65H 29/70 271/188 |
| 9,056,745 | B2 * | 6/2015 | Harada | B65H 5/062 |
| 2002/0038931 | A1 * | 4/2002 | Sugimoto | B65H 5/062 271/109 |
| 2004/0262837 | A1 * | 12/2004 | Hamada | B65H 5/062 271/272 |
| 2009/0166962 | A1 * | 7/2009 | Osakabe | H04N 1/0057 271/264 |
| 2014/0210160 | A1 * | 7/2014 | Akimatsu | B65H 5/06 271/272 |

* cited by examiner

SHEET GUIDING MECHANISM, IMAGE FORMING APPARATUS

INCORPORATION BY REFERENCE

This application is based upon and claims the benefit of priority from the corresponding Japanese Patent Application No. 2015-194317 filed on Sep. 30, 2015, the entire contents of which are incorporated herein by reference.

BACKGROUND

The present disclosure relates to sheet guiding mechanisms and image forming apparatuses.

Generally, an image forming apparatus includes a sheet guiding mechanism configured to guide a sheet material as a medium for image formation along a conveying path. The sheet guiding mechanism includes a pair of sheet guide portions opposed to each other with the conveying path therebetween.

For example, the sheet guiding mechanism guides the sheet material between a registration roller pair and a transfer position. The transfer position is a position between an image carrier that carries a toner image and a transfer portion that transfers the toner image from the image carrier onto the sheet material.

If the direction in which the sheet material advances toward the transfer position varies, the image quality is adversely affected. Therefore, in the sheet guiding mechanism provided in the stage preceding the transfer position, it is important to accurately guide the sheet material to an intended direction.

SUMMARY

A sheet guiding mechanism according to one aspect of the present disclosure includes a conveying path in which a sheet material is conveyed, a pair of first rotators, a pair of second rotators, a first sheet guide portion, a second sheet guide portion, a shaft member, and a plurality of guide rollers. The pair of first rotators is provided in the conveying path, and conveys the sheet material. The pair of second rotators is provided on a downstream side in a conveying direction of the sheet material relative to the pair of first rotators in the conveying path, and conveys the sheet material having been conveyed by the pair of first rotators. The first sheet guide portion is a portion that forms a guide surface configured to guide the sheet material, on a first side of the conveying path. The second sheet guide portion is a portion that forms a guide surface configured to guide the sheet material, on a second side of the conveying path. The shaft member is a member that extends along a width direction orthogonal to the conveying direction of the sheet material, and has both end portions supported by the second sheet guide portion. The plurality of guide rollers are rotatably supported by the shaft member and arranged along the width direction. The plurality of guide rollers are in contact with the sheet material conveyed in the conveying path, and rotate so as to follow the sheet material. The shaft member has flexibility such that the shaft member is bent by a pressure applied from the sheet material to the plurality of guide rollers when a tension is applied to the sheet material between the pair of first rotators and the pair of second rotators.

An image forming apparatus according to another aspect of the present disclosure includes the sheet guiding mechanism, and an image forming portion. The image forming portion forms an image on the sheet material conveyed by the sheet guiding mechanism.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the accompanying drawings. It should be noted that the following embodiments are examples embodying the present disclosure and do not limit the technical scope of the present disclosure.

[First Embodiment]

Figure 1:
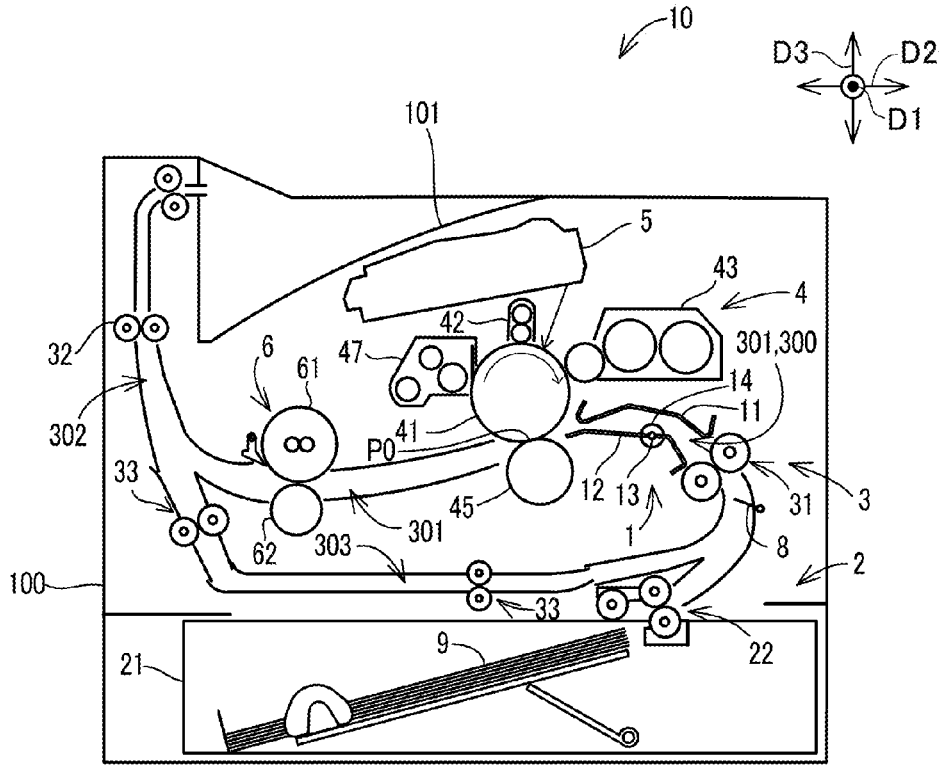
FIG. 1 is a configuration diagram showing an image forming apparatus according to a first embodiment.

First, the configuration of an image forming apparatus 10 according to a first embodiment will be described with reference to FIG. 1. The image forming apparatus 10 is an electrophotographic type image forming apparatus configured to form an image on a sheet material 9. The sheet material 9 is a sheet-shaped medium for image formation, such as paper, coated paper, a postcard, an envelope, or an OHP sheet.

The image forming apparatus 10 includes a sheet conveying mechanism 3, a developing unit 4, an optical scanning portion 5, a fixing portion 6, etc. in an apparatus body 100, and further includes a sheet feed portion 2 in a lower part of the apparatus body 100.

In the sheet feed portion 2, a sheet sending-out portion 22 sends out the sheet material 9 housed in a sheet cassette 21 to a first conveying path 301.

In the sheet conveying mechanism 3, a plurality of conveying roller pairs such as a first conveying roller pair 31 and a second conveying roller pair 32 convey the sheet material 9. The first conveying roller pair 31 conveys the sheet material 9 fed from the sheet feed portion 2, from the first conveying path 301 to a second conveying path 302.

A first direction D1 shown in each figure is a direction along a rotation shaft of each of the plurality of sheet conveying roller pairs such as the first conveying roller pair 31. The first direction D1 is a width direction orthogonal to the conveying direction of the sheet material 9. A second direction D2 is a horizontal direction orthogonal to the first direction D1. A third direction D3 is a direction orthogonal to the first direction D1 and the second direction D2, and is an up-down direction.

The second conveying roller pair 32 rotates forward to convey the sheet material 9 along the second conveying path 302 and discharges the sheet material 9 to a discharge tray 101. The second conveying roller pair 32 can reversely rotate to change the direction of the sheet material 9, whereby the sheet material 9 is conveyed to a third conveying path 303 that merges into the first conveying path 301.

The developing unit 4 includes a drum-like photosensitive member 41, a charging portion 42, a developing portion 43, a transfer portion 45, a cleaning portion 47, etc. The photosensitive member 41 rotates, and the surface of the photosensitive member 41 is uniformly charged by the charging portion 42.

The optical scanning portion 5 performs scanning with laser light, thereby to write an electrostatic latent image onto the surface of the photosensitive member 41. The developing portion 43 develops the electrostatic latent image by using toner. Thus, a toner image is formed on the surface of the photosensitive member 41. The photosensitive member 41 is an example of an image carrier that rotates while carrying the toner image.

The transfer portion 45, in the first conveying path 301, rotates with the sheet material 9 being nipped between itself and the photosensitive member 41, and transfers the toner image from the photosensitive member 41 onto the sheet material 9 while conveying the sheet material 9. In the following description, a position at which the toner image is transferred from the image carrier onto the sheet material 9 is referred to as a transfer position P0. In the present embodiment, the transfer position P0 is a position between the photosensitive member 41 and the transfer portion 45. The transfer portion 45 shown in FIG. 1 is a transfer roller.

The cleaning portion 47 removes the toner remaining on the surface of the photosensitive member 41. In the fixing portion 6, a heating roller 61 and a pressure roller 62 rotate with the sheet material 9 being nipped therebetween. Thus, the heating roller 61 heats the sheet material 9 on which the image has been formed, thereby to fix the toner image onto the sheet material 9.

In the present embodiment, a sheet guiding mechanism 1 is disposed between the first conveying roller pair 31 and the transfer position P0 in the first conveying path 301. The sheet guiding mechanism 1 guides the sheet material 9 conveyed by the first conveying roller pair 31, along the first conveying path 301.

The first conveying roller pair 31 provided in the stage preceding to the transfer position P0 is a registration roller pair. The first conveying roller pair 31 is temporarily stopped at a timing when the roller pair 31 nips a leading end of the sheet material 9, and adjusts a timing to send the sheet material 9 to the transfer position P0. The timing at which the sheet material 9 reaches the first conveying roller pair 31 is determined on the basis of a detection result of a sheet detection sensor 8 provided on the upstream side in the conveying direction of the sheet material 9 in the first conveying path 301.

A portion of the first conveying path 301 between the first conveying roller pair 31 and the transfer position P0 is a curved conveying path. That is, the transfer position P0 is present in a position deviated from an extended line in the direction in which the first conveying roller pair 31 feeds the sheet material 9. In the following description, the portion of the first conveying path 301 between the first conveying roller pair 31 and the transfer position P0 is referred to as a curved conveying path 300. The curved conveying path 300 according to the present embodiment is a curved path. The curved conveying path 300 is an example of the curved portion of the first conveying path 301.

The first conveying roller pair 31 is an example of a pair of first rotators which rotates with the sheet material 9 being nipped therebetween, thereby to convey the sheet material 9. The sheet guiding mechanism 1 guides the sheet material 9 conveyed by the first conveying roller pair 31, along the curved conveying path 300.

The sheet guiding mechanism 1 includes a first sheet guide portion 11 and a second sheet guide portion 12 opposed to each other. The first sheet guide portion 11 forms, outside the curved conveying path 300, a guide surface 11*g* which guides the sheet material 9 conveyed. The guide surface 11*g* is a surface, on the curved conveying path 300 side, of the first sheet guide portion 11. The second sheet guide portion 12 forms, inside the curved conveying path 300, a guide surface 12*g* which guides the sheet material 9 conveyed.

In other words, the surfaces, opposed to each other, of the first sheet guide portion 11 and the second sheet guide portion 12 form the curved conveying path 300. The outside and the inside of the curved conveying path 300 are examples of a first side and a second side of the curved conveying path 300, respectively.

In the present embodiment, the sheet guiding mechanism 1 guides the sheet material 9 which enters obliquely upward, in the horizontal direction or obliquely downward. Accordingly, the first sheet guide portion 11 forms the guide surface 11*g* which guides the sheet material 9, on the upper side of the curved conveying path 300, while the second sheet guide portion 12 forms the guide surface 12*g* which guides the sheet material 9, on the lower side of the curved conveying path 300. The guide surface 12*g* is a surface, on the curved conveying path 300 side, of the second sheet guide portion 12.

The photosensitive member 41 and the transfer portion 45 are an example of a pair of second rotators which rotates with the sheet material 9, having passed through the sheet guiding mechanism 1, being nipped therebetween, thereby to convey the sheet material 9. Conveyance of the sheet material 9 is transferred from the first conveying roller pair 31 to the photosensitive member 41 and the transfer portion 45.

It is also conceivable that, in the transfer portion 45, a rotator which rotates with the sheet material 9 being nipped between itself and the drum-like photosensitive member 41 is an endless belt. The developing unit 4, the optical scanning portion 5, and the fixing portion 6 are an example of an image forming portion which forms an image on the sheet material 9 conveyed by the sheet guiding mechanism 1.

The peripheral speed of the photosensitive member 41 and the transfer portion 45 is slightly higher than the peripheral speed of the first conveying roller pair 31. In this case, the sheet material 9 which is passing through the sheet guiding mechanism 1 is subjected to a small tension F0 (refer to FIG. 4) toward the downstream side in the conveying direction, in the state where the sheet material 9 extends across the first conveying roller pair 31, and the pair of the photosensitive member 41 and the transfer portion 45. Thus, the sheet material 9 is prevented from slacking while the toner image is transferred onto the sheet material 9.

By the way, with size reduction of the image forming apparatus 10, the sheet guiding mechanism 1 is often provided in a curved conveying path such as the curved conveying path 300. In this case, a tension is applied to the sheet material 9 due to the sheet conveying portions on the upstream side and the downstream side, in the sheet conveying direction, of the sheet guiding mechanism 1, whereby the sheet material 9 is likely to be strongly rubbed against the second sheet guide portion 12.

In the present embodiment, the sheet conveying portion on the upstream side in the sheet conveying direction is the first conveying roller pair 31, and the sheet conveying portion on the downstream side in the sheet conveying direction is the photosensitive member 41 and the transfer portion 45.

When a friction applied from the sheet guiding mechanism 1 to the sheet material 9 is great, problems such as degradation of image quality and generation of paper powder from the sheet material 9 are likely to occur due to variation in the conveying speed of the sheet material 9.

Further, in the sheet guiding mechanism 1 provided in the stage preceding to the transfer position P0, if the space between the first sheet guide portion 11 and the second sheet guide portion 12 is small, the conveying path is narrow, and variation in the advancing direction of the sheet material 9 toward the transfer position P0 is reduced.

However, when the space between the first sheet guide portion 11 and the second sheet guide portion 12 is small, the sheet material 9 is strongly rubbed against the pair of sheet guide portions 11 and 12, and the aforementioned problems become significant.

Further, when the tension is applied to the sheet material 9 in the curved conveying path 300, wrinkles are likely to be generated on the sheet material 9 in the downstream-side sheet conveying portion. Particularly when the sheet material 9 is thin, wrinkles are more likely to be generated on the sheet material 9.

The sheet guiding mechanism 1 is a mechanism capable of reducing the friction applied to the sheet material 9 and reducing variation in the advancing direction of the sheet material 9 when the sheet material 9 is guided along a curved conveying path. Further, when the sheet guiding mechanism 1 is adopted, wrinkles are less likely to be generated on the sheet material 9. Hereinafter, sheet guiding mechanism 1 will be described in detail.

[Sheet Guiding Mechanism 1]

Figure 2:
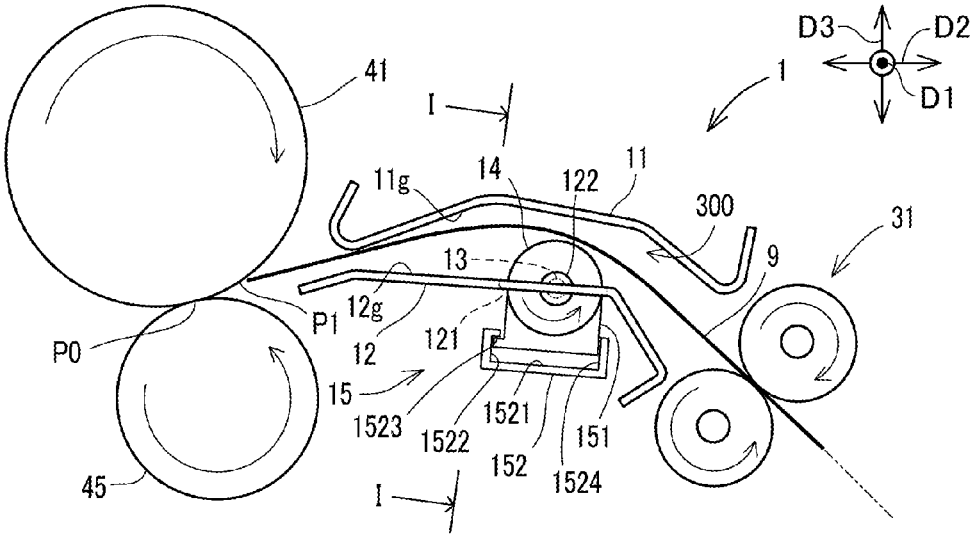
FIG. 2 is a side view of a sheet guiding mechanism and preceding and following units in the image forming apparatus according to the first embodiment.
Figure 3:
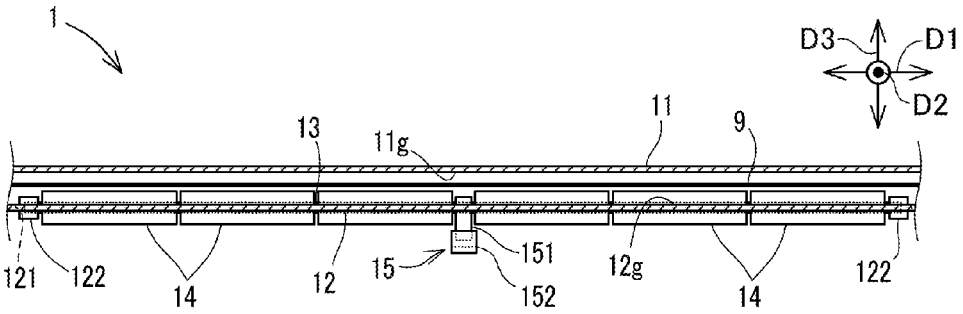
FIG. 3 is a cross-sectional view of the sheet guiding mechanism.

As shown in FIGS. 2 and 3, the sheet guiding mechanism 1 includes, in addition to the first sheet guide portion 11 and the second sheet guide portion 12, a shaft member 13 and a plurality of guide rollers 14. Each of the guide rollers 14 is a rotator having a cylindrical outer circumferential surface. For example, it is conceivable that each of the guide rollers 14 is a synthetic resin member. FIG. 3 shows a cross section at a I-I plane shown in FIG. 2, and FIG. 5 shows a cross section at a II-II plane shown in FIG. 4.

Figure 6:
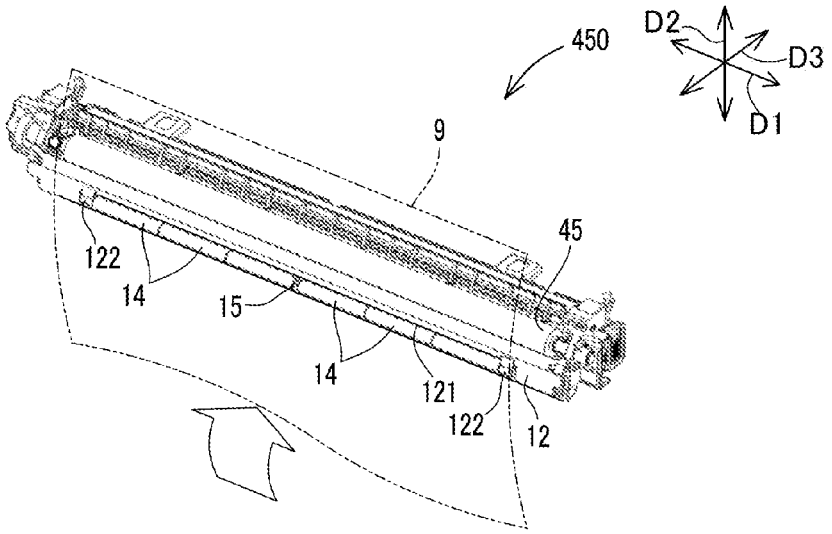
FIG. 6 is a perspective view of a transfer unit in the image forming apparatus according to the first embodiment.

As shown in FIG. 6, the transfer portion 45 as a transfer roller, the second sheet guide portion 12, the shaft member 13, and the plurality of guide rollers 14 are integrally formed as a transfer unit 450.

In the second sheet guide portion 12, an opening 121 is formed along the first direction D1. For example, the opening 121 is formed in a band shape along the first direction D1.

The shaft member 13 is a rod-shaped member formed along the first direction D1. Both end portions of the shaft member 13 are supported by bearing portions 122 provided at two positions in the second sheet guide portion 12, respectively.

The bearing portions 122 are provided near the both ends, in the first direction D1, of the opening 121 of the second sheet guide portion 12. For example, in the second sheet guide portion 12, the member forming the guide surface 12*g* is a metal member, and the bearing portions 122 made of a synthetic resin are mounted to the metal member.

It is also conceivable that portions of the metal member are the bearing portions 122. It is also conceivable that the member forming the guide surface 12*g* is a synthetic resin member.

The shaft member 13 is a single member formed so as to extend from the position near one end, in the first direction D1, of the opening 121 of the second sheet guide portion 12 to the position near the other end thereof. For example, it is conceivable that the shaft member 13 is a relatively thin metal member. Alternatively, the shaft member 13 may be a synthetic resin member.

As shown in FIGS. 2, 3, and 5, the plurality of guide rollers 14 are rotatably supported by the shaft member 13 and are arranged side by side along the first direction D1. The plurality of guide rollers 14 are supported by the shaft member 13 with a gap formed therebetween so that the shaft member 13 is allowed to slightly bend. Further, a hole of each guide roller 14, through which the shaft member 13 penetrates, has a margin between itself and the shaft member 13 so that the guide roller 14 can rotate even if the shaft member 13 slightly bends.

Figure 4:
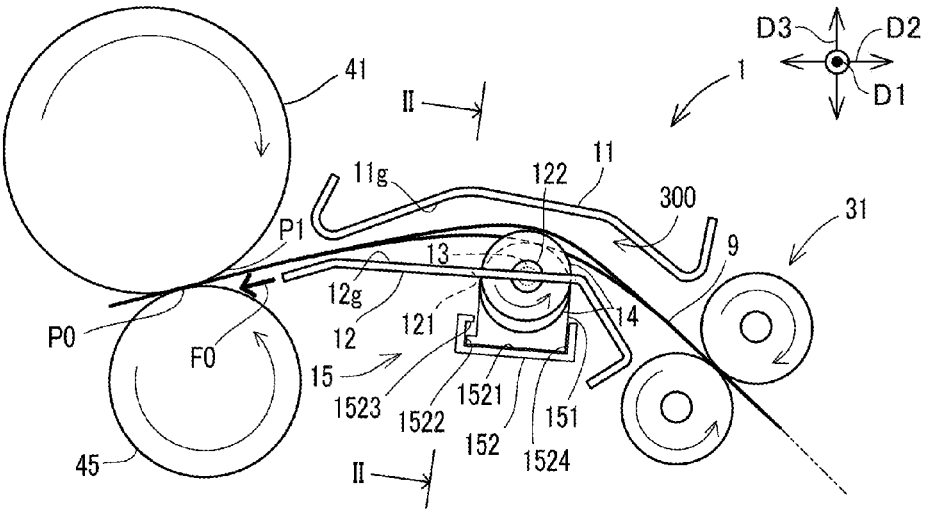
FIG. 4 is a side view of the sheet guiding mechanism and the preceding and following units in the case where a tension is applied to a sheet material.
Figure 5:
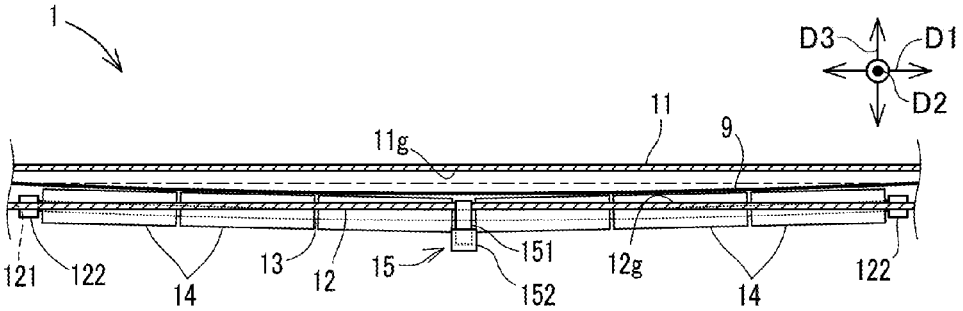
FIG. 5 is a cross-sectional view of the sheet guiding mechanism in the case where a tension is applied to the sheet material.

As shown in FIGS. 2 and 4, a portion of the outer circumferential surface of each of the plurality of guide rollers 14 protrudes to the curved conveying path 300 from the opening 121 of the second sheet guide portion 12.

A gap is formed between the first sheet guide portion 11 and each of the plurality of guide rollers 14. That is, the plurality of guide rollers 14 guide the sheet material 9 to the path near the first sheet guide portion 11 in the curved conveying path 300.

Then, the plurality of guide rollers 14 and portions, downstream of the position of the guide rollers 14, of the first sheet guide portion 11 and the second sheet guide portion 12 guide the leading end of the sheet material 9 to a target position P1. The target position P1 is the transfer position P0 or a position near the transfer position P0.

In the examples shown in FIGS. 2 and 4, the target position P1 is a position on the outer circumferential surface of the photosensitive member 41, which position is slightly upstream of the transfer position P0 in the sheet conveying direction. Thereby, the leading end of the sheet material 9 enters the transfer position P0 along the outer circumferential surface of the photosensitive member 41. The sheet guiding mechanism 1 guides the sheet material 9 along a path having a minimum angle with respect to a plane that circumscribes the circumferential surface of the photosensitive member 41 at the transfer position P0.

Since the curved conveying path 300 is narrowed by the plurality of guide rollers 14, variation in the advancing direction of the sheet material 9 toward the transfer position P0 is reduced. In addition, since the plurality of guide rollers 14 rotate so as to follow the moving sheet material 9, the friction applied to the sheet material 9 is reduced.

As shown in FIG. 4, the sheet material 9 is subjected to the small tension F0 toward the downstream side in the conveying direction, in the state where the sheet material 9 extends across the first conveying roller pair 31 and the transfer position P0.

As shown in FIGS. 4 and 5, the shaft member 13 has flexibility such that the shaft member 13 is bent by a pressure applied from the sheet material 9 to the plurality of guide rollers 14 when the tension F0 is applied to the sheet material 9. The both end portions of the shaft member 13 are supported by the fixed bearing portions 122. Therefore, the shaft member 13 is bent such that the center portion thereof in the first direction D1 is displaced so as to be retracted from the curved conveying path 300 (refer to FIG. 5). The side to which the center portion of the shaft member 13 is retracted from the curved conveying path 300 is considered to be the side opposite to the curved conveying path 300 with respect to the second sheet guide portion 12.

Accordingly, the sheet material 9 slightly curves such that the center portion thereof in the first direction D1 is displaced toward the second sheet guide portion 12 side (refer to FIG. 5). When the sheet material 9 is thus curved, a tension, from the center toward the both sides in the first direction D1, is applied at the transfer position P0 from the photosensitive member 41 and the transfer portion 45 to the sheet material 9. This tension suppresses generation of wrinkles on the sheet material 9 at the transfer position P0.

The sheet guiding mechanism 1 further includes a shaft deformation restricting portion 15. When the center portion, in the first direction D1, of the shaft member 13 is displaced due to bending of the shaft member 13, the shaft deformation restricting portion 15 restricts the range of the displacement.

The shaft deformation restricting portion 15 includes: a displacement portion 151 mounted to the center portion, in the first direction D1, of the shaft member 13; and a displacement restricting portion 152 fixed to, for example, a main body portion of the transfer unit 450. The displacement portion 151 is formed so as to protrude from the second sheet guide portion 12 to the side opposite to the first sheet guide portion 11. The displacement restricting portion 152 restricts the range of displacement of the displacement portion 151, thereby to restrict the range within which the center portion, in the first direction D1, of the shaft member 13 can be displaced.

As shown in FIG. 2, the displacement restricting portion 152 includes a first displacement restricting portion 1521, a second displacement restricting portion 1522, a third displacement restricting portion 1523, and a fourth displacement restricting portion 1524.

The first displacement restricting portion 1521 is formed across a gap with respect to a surface, on the side opposite to the curved conveying path 300, of the displacement portion 151. The center portion of the shaft member 13 can be displaced only within a range until the displacement portion 151 comes into contact with the first displacement restricting portion 1521, on the side opposite to the curved conveying path 300.

That is, the first displacement restricting portion 1521 restricts, to a predetermined range, the range in which the center portion of the shaft member 13 is displaced so as to be retracted from the curved conveying path 300 due to bending of the shaft member 13. Thus, the sheet material 9 is prevented from being excessively curved in the first direction D1 when the tension F0 is applied to the sheet material 9.

The second displacement restricting portion 1522 is formed in contact with a surface, on the downstream side in the sheet conveying direction, of the displacement portion 151. Therefore, the center portion of the shaft member 13 cannot be displaced toward the downstream side in the sheet conveying direction.

That is, the second displacement restricting portion 1522 restricts displacement of the center portion of the shaft member 13 in the conveying direction of the sheet material 9 due to bending of the shaft member 13. Thus, the shaft member 13 is prevented from bending in the conveying direction of the sheet material 9.

For example, in the case where the leading end of the sheet material 9 hits the guide roller 14, even when the shaft member 13 is subjected to a pressure from the upstream side to the downstream side in the sheet conveying direction, the shaft member 13 does not bend in the conveying direction of the sheet material 9. As a result, the advancing direction of the sheet material 9 is prevented from varying due to bending of the shaft member 13.

The third displacement restricting portion 1523 is formed in contact with a surface, facing the curved conveying path 300, of the displacement portion 151. Therefore, the center portion of the shaft member 13 cannot be displaced toward the first sheet guide portion 11.

That is, the third displacement restricting portion 1523 restricts displacement of the center portion of the shaft member 13 toward the first sheet guide portion 11 due to bending of the shaft member 13. Thus, the shaft member 13 is prevented from bending toward the first sheet guide portion 11.

For example, in the case where the leading end of the sheet material 9 hits the guide roller 14, even when the shaft member 13 is subjected to a pressure toward the first sheet guide portion 11, the shaft member 13 does not bend toward the first sheet guide portion 11. As a result, the advancing direction of the sheet material 9 is prevented from varying due to bending of the shaft member 13.

The fourth displacement restricting portion 1524 is formed in contact with a surface, on the upstream side in the sheet conveying direction, of the displacement portion 151. Therefore, the center portion of the shaft member 13 cannot be displaced to the upstream side in the sheet conveying direction.

That is, the fourth displacement restricting portion 1524 restricts displacement of the center portion of the shaft member 13 in the direction opposite to the conveying direction of the sheet material 9 due to bending of the shaft member 13. Thus, the shaft member 13 is prevented from bending in the direction opposite to the conveying direction of the sheet material 9.

As described above, the displacement restricting portion 152 guides the displacement portion 151 mounted to the center portion of the shaft member 13, along the linear direction orthogonal to the conveying direction of the sheet material 9, so that the displacement portion 151 can be reciprocally displaced within a certain restriction range. Thus, the direction in which the center portion of the shaft member 13 bends is restricted to the direction in which the center portion of the shaft member 13 retracts from the curved conveying path 300. Further, the maximum amount of bending of the shaft member 13, that is, the maximum amount of displacement of the center portion of the shaft member 13 is also restricted within a certain range.

[Second Embodiment]

Next, the configuration of an image forming apparatus 10A according to a second embodiment will be described with reference to FIG. 7. The image forming apparatus 10A also includes a sheet guiding mechanism 1, similarly to the image forming apparatus 10. However, the image forming apparatus 10A is different from the image forming apparatus 10 in the direction of the conveying path in which the sheet guiding mechanism 1 is provided.

Figure 7:
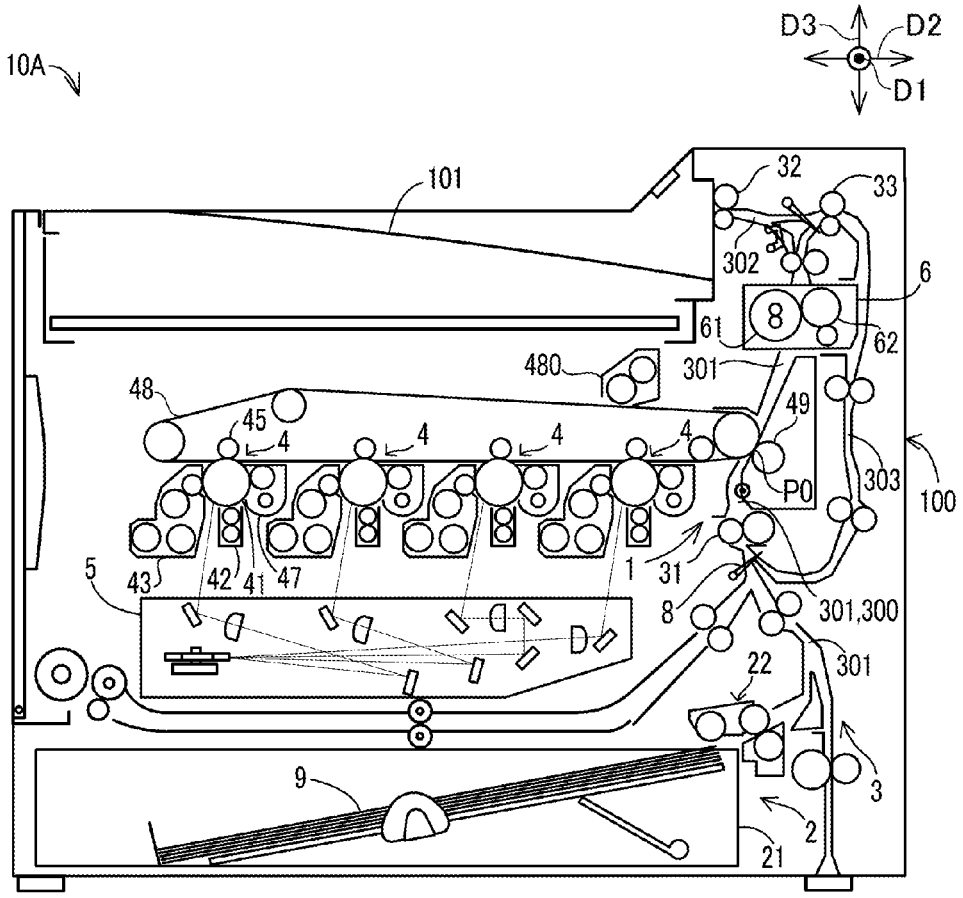
FIG. 7 is a configuration diagram showing an image forming apparatus according to a second embodiment.

In FIG. 7, the same components as those shown in FIGS. 1 to 6 are designated by the same reference characters.

Hereinafter, the difference of the image forming apparatus 10A from the image forming apparatus 10 will be described.

The image forming apparatus 10A is a tandem-type image forming apparatus, and is a color printer. Therefore, the image forming apparatus 10A includes a plurality of developing units 4 corresponding to colors of cyan, magenta, yellow, and black, respectively. The optical scanning portion 5 writes the electrostatic latent image on the photosensitive member 41 of each of the plurality of developing units 4.

The tandem-type image forming apparatus 10A further includes an intermediate transfer belt 48, a secondary transfer portion 49, and a secondary cleaning portion 480, in addition to the components of the image forming apparatus 10.

In the image forming apparatus 10A, the transfer portion 45 of each of the plurality of developing units 4 transfers the toner image on the surface of the photosensitive member 41, onto the intermediate transfer belt 48. Thereby, the toner images of the plurality of colors are formed on the intermediate transfer belt 48.

In the second conveying path 302, the secondary transfer portion 49 transfers, onto the sheet material 9, the toner images of the plurality of colors formed on the intermediate transfer belt 48. The secondary cleaning portion 480 removes the toner remaining on the intermediate transfer belt 48.

In the image forming apparatus 10A, the intermediate transfer belt 48 is also an example of the image carrier which rotates while carrying the toner image. In addition, the secondary transfer portion 49 is an example of the transfer portion which transfers the toner image from the image carrier onto the sheet material 9.

A transfer position P0 in the image forming apparatus 10A is a position between the intermediate transfer belt 48 and the secondary transfer portion 49. The secondary transfer portion 49 transfers the toner image on the surface of the intermediate transfer belt 48 onto the sheet material 9, in the first conveying path 301 to which the sheet feed portion 2 feeds the sheet material 9 in the cassette 21.

In the present embodiment, the sheet guiding mechanism 1 is provided in the curved conveying path 300, between the first conveying roller pair 31 and the transfer position P0, of the first conveying path 301. In the present embodiment, the first conveying path 301 is formed along the longitudinal direction.

Also in the image forming apparatus 10A, similarly to the image forming apparatus 10, the first conveying roller pair 31 is an example of a pair of first rotators which rotates with the sheet material 9 being nipped therebetween to convey the sheet material 9. The sheet guiding mechanism 1 guides, along the curved conveying path 300, the sheet material 9 conveyed by the first conveying roller pair 31.

Further, in the image forming apparatus 10A, the intermediate transfer belt 48 and the secondary transfer portion 49 are an example of a pair of second rotators which rotates with the sheet material 9, having passed through the sheet guiding mechanism 1, being nipped therebetween, thereby to convey the sheet material 9. Conveyance of the sheet material 9 is transferred from the first conveying roller pair 31 to the intermediate transfer belt 48 and the secondary transfer portion 49. The peripheral speed of the intermediate transfer belt 48 and the secondary transfer portion 49 is slightly higher than the peripheral speed of the first conveying roller pair 31.

The secondary transfer portion 49 shown in FIG. 7 is a transfer roller. It is also conceivable that, in the secondary transfer portion 49, a rotator which rotates with the sheet material 9 being nipped between itself and the intermediate transfer belt 48 is an endless belt.

Also in the case where the sheet guiding mechanism 1 is applied to the tandem-type image forming apparatus 10A, the same effects as those of the image forming apparatus 10 can be achieved.

[Application Examples]

In the embodiments described above, it is also conceivable that the sheet guiding mechanism 1 is applied to a conveying path other than the conveying path between the first conveying roller pair 31 and the transfer position P0.

For example, in the image forming apparatus 10, it is also conceivable that the sheet guiding mechanism 1 is provided in a conveying path between the transfer position P0 and the fixing portion 6. In this case, the photosensitive member 41 and the transfer portion 45 are an example of the pair of first rotators, and the heating roller 61 and the pressure roller 62 in the fixing portion 6 are an example of the pair of second rotators.

Likewise, it is also conceivable that, in the image forming apparatus 10A, the sheet guiding mechanism 1 is provided in the conveying path between the transfer position P0 and the fixing portion 6. In this case, the intermediate transfer belt 48 and the secondary transfer portion 49 are an example of the pair of first rotators, and the heating roller 61 and the pressure roller 62 in the fixing portion 6 are an example of the pair of second rotators.

Further, it might be considered that the sheet guiding mechanism 1 is provided in a conveying path along a plane. For example, it is conceivable that, in the image forming apparatus 10, the conveying path between the first conveying roller pair 31 and the transfer position P0 is a conveying path along a plane.

Further, it is conceivable that the plurality of guide rollers 14 protrude toward the first sheet guide portion 11 with respect to a plane including the transfer position P0 and the plane at which the pair of first conveying rollers 31 contact with each other. In this case, since the plurality of guide rollers 14 are present, the sheet material 9 is guided along a path passing around the plurality of guide rollers 14, that is, a substantially curved path.

When the tension F0 is applied to the sheet material 9, the shaft member 13 supporting the plurality of guide rollers 14 bends, and the sheet material 9 curves in the first direction D1. As a result, it is possible to achieve the same effects as those achieved in the case where the sheet guiding mechanism 1 is provided in a curved conveying path.

The sheet guiding mechanism and the image forming apparatus according to the present disclosure can be implemented by optionally combining the embodiment and the application examples as described above, or by modifying or partially omitting the embodiment and the application examples as appropriate within the scope of the disclosure defined by claims.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet guiding mechanism comprising:

a conveying path in which a sheet material is conveyed;

a pair of first rotators provided in the conveying path, and configured to convey the sheet material;

a pair of second rotators provided on a downstream side in a conveying direction of the sheet material relative to the pair of first rotators in the conveying path, and configured to convey the sheet material conveyed by the pair of first rotators;

a first sheet guide portion forming a first guide surface configured to guide the sheet material, on a first side of the conveying path;

a second sheet guide portion forming a second guide surface configured to guide the sheet material, on a second side of the conveying path;

a shaft member extending along a width direction orthogonal to the conveying direction of the sheet material, and having both end portions supported by the second sheet guide portion;

a plurality of guide rollers rotatably supported by the shaft member and arranged along the width direction, the guide rollers being in contact with the sheet material conveyed in the conveying path, and rotating so as to follow the sheet material; and a shaft deformation restricting portion that includes:

a displacement portion mounted to a center portion, in the width direction, of the shaft member; and a displacement restricting portion configured to restrict a range of displacement of the displacement portion toward the first sheet guide portion and toward a side opposite to the first sheet guide portion by coming into contact with the displacement portion, wherein the shaft member has flexibility such that the shaft member is bent by a pressure applied from the sheet material to the plurality of guide rollers when a tension is applied to the sheet material between the pair of first rotators and the pair of second rotators, and the shaft deformation restricting portion restricts the range of the displacement when the center portion, in the width direction, of the shaft member is displaced due to bending of the shaft member.

2. The sheet guiding mechanism according to claim 1, wherein the conveying path includes a curved portion curved in the conveying direction, the first sheet guide portion forms the first guide surface outside the curved portion, and the second sheet guide portion forms the second guide surface inside the curved portion.

3. The sheet guiding mechanism according to claim 1, the displacement restricting portion includes a first displacement restricting portion configured to restrict, within a predetermined range, the range in which a center portion, in the width direction, of the shaft member is displaced so as to be retracted from the conveying path due to bending of the shaft member.

4. The sheet guiding mechanism according to claim 1, the displacement restricting portion includes a side displacement restricting portion configured to prevent displacement of a center portion, in the width direction, of the shaft member toward the conveying direction of the sheet material due to bending of the shaft member.

5. The sheet guiding mechanism according to claim 1, the displacement restricting portion includes a third displacement restricting portion configured to prevent displacement of a center portion, in the width direction, of the shaft member toward the first sheet guide portion due to bending of the shaft member.

6. The sheet guiding mechanism according to claim 1, wherein the pair of second rotators has a peripheral speed higher than that of the pair of first rotators.

7. An image forming apparatus comprising:

the sheet guiding mechanism according to claim 1; and an image forming portion configured to form an image on the sheet material conveyed by the sheet guiding mechanism.

8. The image forming apparatus according to claim 7, wherein the pair of first rotators is a registration roller pair, one of the pair of second rotators is an image carrier configured to rotate with carrying a toner image, the other of the pair of second rotators is a transfer roller configured to rotate with the sheet material being nipped between the transfer roller and the image carrier, and transfer the toner image from the image carrier onto the sheet material while conveying the sheet material.

* * * * *